US005399275A

United States Patent [19]

Lange et al.

[11] Patent Number: 5,399,275

[45] Date of Patent: Mar. 21, 1995

[54] ENVIRONMENTALLY FRIENDLY VISCOSITY INDEX IMPROVING COMPOSITIONS

[75] Inventors: Richard M. Lange, Euclid; Joseph G. Seebauer, Mentor-on-the-Lake; Conrad A. Mamajek, Hudson, all of Ohio

[73] Assignee: The Lubrizol Corporation, Wickliffe, Ohio

[21] Appl. No.: 166,125

[22] Filed: Dec. 10, 1993

Related U.S. Application Data

[63] Continuation-in-part of Ser. No. 993,143, Dec. 18, 1992, abandoned.

[51] Int. Cl.[6] ..... C10M 141/000

[52] U.S. Cl. ..... 252/49.008; 252/56 R; 252/56 S; 252/50; 252/51.005 A; 252/51.005 R

[58] Field of Search ..... 252/51.5 A, 56 S, 56 R, 252/50, 49.8

[56] References Cited

U.S. PATENT DOCUMENTS

| | | | |
|---|---|---|---|
| 3,702,300 | 11/1972 | Coleman | 252/51.5 |
| 3,933,761 | 1/1976 | Coleman | 252/56 D |
| 4,391,721 | 7/1983 | Pappas | 252/51.5 |
| 4,559,153 | 12/1985 | Baldwin et al. | 252/48.6 |
| 4,604,221 | 8/1986 | Bryant et al. | 252/51.5 |
| 4,753,743 | 6/1988 | Sech | 252/56 S |
| 4,783,274 | 11/1988 | Jokinen et al. | 252/56 S |
| 4,885,104 | 12/1989 | Sturwold | 252/56 S |
| 4,921,624 | 5/1990 | Kammann, Jr. | 252/56 S |
| 4,970,011 | 11/1990 | Kuwamoto et al. | 252/56 |
| 5,094,764 | 3/1992 | Kuwamoto et al. | 252/49.3 |

*Primary Examiner*—Jacqueline V. Howard

*Attorney, Agent, or Firm*—James L. Cordek; Frederick D. Hunter, Sr.; Joseph P. Fischer

[57] ABSTRACT

A lubricant composition having improved viscosity index characteristics is described that comprises (A) at least one vegetable or synthetic triglyceride oil of the formula wherein $R^1$, $R^2$ and $R^3$ are aliphatic hydrocarbyl groups having at least 60 percent monounsaturated character and containing from about 6 to about 24 carbon atoms and further wherein an oleic acid moiety:linoleic acid moiety is from about 2 up to about 90 and (B) at least one mixed ester of a carboxy-containing interpolymer.

Optionally, the composition may also contain (C) a synthetic ester base oil, and (D) an antioxidant.

28 Claims, No Drawings

ENVIRONMENTALLY FRIENDLY VISCOSITY INDEX IMPROVING COMPOSITIONS

This is a continuation-in-part of copending application Ser. No. 07/993,143 filed on Dec. 18, 1992, now abandoned.

FIELD OF THE INVENTION

The present invention relates to triglyceride oils having viscosity index improving characteristics wherein the triglyceride oils contain at least a 60 percent monounsaturated content. Triglyceride oils containing this viscosity index improver have utility in passenger car motor oils (PCMO), gear oils, automatic transmissions fluids (ATF), hydraulic fluids, chain bar lubricants, way lubricants for machinery operations, diesel lubricants and tractor fluids.

BACKGROUND OF THE INVENTION

Environmentally friendly fluids comprise mainly vegetable oils. Vegetable oils have a low viscosity and therefore tend to flow off surfaces providing poor film forming and thus giving poor lubrication.

In order to "body up" the vegetable oils a polymeric viscosity improver is utilized. The problem is in finding a viscosity improver that is soluble in vegetable oils.

U.S. Pat. No. 4,391,721 (Pappas, Jul. 5, 1983) relates to dispersant viscosity index improvers that comprise the reaction product of an aliphatic alcohol or mixtures thereof, a tertiary amino alcohol and a styrene maleic anhydride copolymer. The lubricating oil additives of this invention are prepared by first copolymerizing styrene and maleic anhydride, reacting the copolymer with a $C_6$ or greater aliphatic alcohol or mixture of aliphatic alcohols until the copolymer is substantially completely esterified and then transesterifying with a tertiary amino alcohol. By transesterifying, the inventor means displacing the aliphatic alcohol from a fraction of the ester groups and replacing them in the ester with a tertiary amino alcohol.

U.S. Pat. Nos. 4,970,011 and 5,094,764 (Kuwamoto et al, Nov. 13, 1990 and Mar. 10, 1992) relate to a lubricating oil composition containing as essential ingredients a lubricating oil component having a melting point of not higher than 100° C., and one or more water-soluble dispersants selected from the group consisting of anionic polymeric dispersants of a molecular weight of 250 to 25,000, and polyoxyethylene type surfactants of a molecular weight of 3,000 to 20,000 and an HLB value of at least 18, said lubricating oil component being present in a stably dispersed state in water, achieves excellent adhesion when supplied to a machined portion.

U.S. Pat. No. 3,702,300 (Coleman, Nov. 7, 1972) relates to a carboxy-containing interpolymer in which some of the carboxy radicals are esterified and the remaining carboxy radicals are neutralized by reaction with a polyamino compound having one primary or secondary amino group which is useful as an additive in lubricating compositions and fuels. The interpolymer is especially effective to impart desirable viscosity characteristics and anti-sludge properties to a lubricating oil.

SUMMARY OF THE INVENTION

An environmentally friendly viscosity index improving composition is disclosed which comprises (A) at least one vegetable or synthetic triglyceride oil of the formula

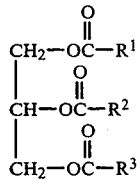

wherein $R^1$, $R^2$ and $R^3$ are aliphatic hydrocarbyl groups having at least 60 percent monounsaturated character and containing from about 6 to about 24 carbon atoms, and (B) at least one mixed ester of a carboxy-containing interpolymer.

In addition to components (A) and (B) the composition may also contain (C) a synthetic ester base oil and/or (D) an antioxidant.

DETAILED DESCRIPTION OF THE INVENTION (A) The Triglyceride Oil

In practicing this invention a triglyceride oil is employed which is a natural or synthetic oil of the formula

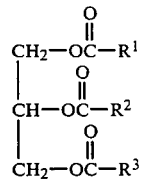

Within the triglyceride formula are aliphatic hydrocarbyl groups having at least 60 percent monounsaturated character and containing from about 6 to about 24 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are vegetable oil triglycerides. The synthetic triglycerides are those formed by the reaction of one mole of glycerol with three moles of a fatty acid or mixture of fatty acids. Preferred are vegetable oil triglycerides.

Regardless of the source of the triglyceride oil, the fatty acid moieties are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 20–40 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ and $R^3COO^-$ that are attached to the 1,2,3-propanetriyl group $$-CH_2\overset{|}{C}HCH_2$$

are the residue of an oleic acid molecule. U.S. Pat. Nos. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 5% palmitic acid, 7% linoleic and 8% hexadecanoic acid, the monounsaturated content is 70%. The preferred triglyceride oils are high oleic (at least 60 percent) acid triglyceride oils. Typical high oleic vegetable oils employed within the instant invention are high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein. A preferred high oleic vegetable oil is high oleic sunflower oil obtained from Helianthus sp. This product is available from SVO Enterprises Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from Brassica campestris or Brassica napus, also available from SVO Enterprises as RS® high oleic rapeseed oil. RS80 signifies a rapeseed oil wherein the acid moieties comprise 80 percent oleic acid.

It is to be noted the olive oil is excluded as a vegetable oil in this invention. The oleic acid content of olive oil typically ranges from 65–85 percent. This content, however, is not achieved through genetic modification, but rather is naturally occurring.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di-unsaturated acid moieties (20+70 or 40+50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

Non-genetically modified vegetable oils having utility in this invention are sunflower oil, safflower oil, corn oil, soybean oil, rapeseed oil, meadowfoam oil, lesquerella oil or castor oil.

(B) The Carboxy-Containing Interpolymer

The carboxy-containing interpolymer (B) comprises (1) a nitrogen-containing mixed ester having an inherent viscosity of from about 0.05 to about 2 and being derived from at least two monomers, one of said monomers being a low molecular weight aliphatic olefin or styrene and the other of said monomers being an alpha, beta-unsaturated aliphatic acid, anhydride or ester thereof, wherein the carboxylic acid, dicarboxylic acid, anhydride or ester is at least 80 percent esterified after polymerization and being characterized by the presence within its polymeric structure of at least one of each of three pendant polar groups which are derived from the carboxy groups of said nitrogen-containing ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, (C) a carbonyl-polyamino group derived from a polyamino compound having one primary or secondary amino group, wherein the molar ratio of (A):(B):(C) is (50–95):(5–50):(0.1–15);

(2) a mixed ester of a terpolymer having an inherent viscosity of from about 0.05 to about 2, of a vinyl aromatic monomer, an alpha, beta-unsaturated carboxylic acid, dicarboxylic acid, anhydride or ester thereof, and an interpolymerizable comonomer wherein the carboxylic acid, anhydride or ester is at least 80 percent esterified after polymerization and wherein the ester contains pendant polar groups (A) and (B) wherein:

(A) is a carboxylic ester group having at least 8 aliphatic carbon atoms in an alkyl portion of the ester radical, (B) is a relatively low molecular weight carboxylic ester group having no more than 7 aliphatic carbon atoms in the ester radical, wherein the molar ratio of (A):(B) is (1–20):(1), and optionally (C) a carbonyl-polyamino group derived from a polyamino compound having one primary or secondary amino group, wherein the molar ratio of (A):(B):(C) is (50–95):(5–50):(0.1–15); and (3) a nitrogen-free mixed ester of a carboxy-containing interpolymer having an inherent viscosity of from about 0.05 to about 2.0 and being derived from at least two monomers, one of said monomers being a low molecular weight aliphatic olefin or styrene and the other of said monomers being an alpha, beta-unsaturated aliphatic acid, dicarboxylic acid, anhydride or ester thereof, wherein the carboxylic acid, anhydride or ester is at least 80 percent esterified after polymerization and wherein the ester contains pendant polar groups (A) and (B) comprising:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, wherein the molar ratio of (A):(B) is (1–20):(1).

Regardless of which mixed ester of a carboxy-containing interpolymer is employed, (B)(1), (B)(2) or (B)(3), the interpolymer has an inherent viscosity of from about 0.05 to about 2. In (B)(1) and (B)(3), the interpolymers are derived from at least two monomers, one of said monomers being a low molecular weight aliphatic olefin or styrene and the other of said monomers being an alpha, beta-unsaturated aliphatic acid anhydride or ester. In (B)(2) the interpolymer is a terpolymer of the above two monomers of (B)(1) and (B)(2) and also contains an interpolymerizable comonomer.

The formed interpolymer is then reacted with alcohols such that the interpolymer is at least 80 percent esterified. In (B)(1) the ester is characterized by the presence within its polymeric structure of pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polyamino group derived from a polyamino compound having no primary or secondary amino group, wherein the molar ratio of (A):(B):(C) is (50–95):(5–50):(0.1–15).

In (B-2) the mixed ester is a terpolymer wherein the ester is characterized by the presence within its polymeric structure of pendant polar groups (A) and (B) as defined above wherein the molar ratio of (A):(B) is (1–20):(1). Optionally pendant polar group (C) may be employed and the molar ratio of (A):(B):(C) in (B-2) is the same as the molar ratio of (A):(B):(C) in (B-1).

In (B-3) the mixed ester is a nitrogen-free mixed ester characterized by the presence within its polymeric structure of pendant polar groups (A) and (B) as defined above wherein the molar ratio (A):(B) in (B-3) is the same as the molar ratio of (A):(B) in (B-2).

An essential element of the esters of component (B) is that they are mixed esters, i.e., one in which there is the combined presence of both a high molecular weight ester group and a low molecular weight ester group, particularly in the ratios as stated above. Such combined presence is critical to the viscosity properties of the mixed ester, both from the standpoint of its viscosity modifying characteristics and from the standpoint of its thickening effect upon lubricating compositions in which it is used as an additive.

In reference to the size of the ester groups, it is pointed out that an ester radical is represented by the formula

—C(O)(OR)

and that the number of carbon atoms in an ester radical is the combined total of the carbon atoms of the carbonyl group and the carbon atoms of the ester alkyl group i.e., the (OR) group.

An essential element of Component (B)(1) and optionally of (B)-(2) is the presence of a polyamino group derived from a particular polyamino compound, i.e., one in which there is one primary or secondary amino group and at least one tertiary amine or nitrogen heterocyclic moiety. Such polyamino groups, when present in the nitrogen-containing esters of (B)(1) and optionally of (B)(2) in the proportion stated above enhances the dispersability of such esters in lubricant compositions and additive concentrates for lubricant compositions.

Still another essential element of Component (B)(1) and optionally (B)(2) is the extent of esterification in relation to the extent of neutralization of the unesterified carboxy groups of the carboxy-containing interpolymer through the conversion thereof to polyamino-containing groups. For convenience, the relative proportions of the high molecular weight ester group to the low molecular weight ester group and to the polyamino group are expressed in terms of molar ratios of (50–95):(5–50):0.1–15), respectively. The preferred ratio is (70–85):(15–30):5. It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In a particularly advantageous embodiment of the invention such linkage is imide or predominantly imide.

Still another important element of Component (B) is the molecular weight of the carboxy-containing interpolymer. For convenience, the molecular weight is expressed in terms of the "inherent viscosity" of the interpolymer which is a widely recognized means of expressing the molecular size of a polymeric substance. As used herein, the inherent viscosity is the value obtained in accordance with the formula $$\text{Inherent Viscosity} = \frac{\ln\,(\text{relative viscosity})}{\text{concentration}}$$

wherein the relative viscosity is measured in a dilution viscometer and is determined by dividing the flow time of a solution of the interpolymer in 100 ml. of acetone, by the flow time of acetone at 30°±0.02° C. For purpose of computation by the above formula, the concentration is the number of grams of the interpolymer per 100 ml. of acetone. The unit of inherent viscosity is the deciliter per gram ($dLg^{-1}$). A more detailed discussion of inherent viscosity, as well as its relationship to the average molecular weight of an interpolymer, appears in Jan F. Rabek, Experimental Methods in Polymer Chemistry, (1983 Edition), pages 126, et seq. (incorporated herein by reference for purposes of describing and disclosing inherent viscosity and means for determining such).

While interpolymers having an inherent viscosity of from about 0.05 to about 2 are contemplated in Component (B), the preferred interpolymers are those having an inherent viscosity of from about 0.1 to about 1. In most instances, interpolymers having an inherent viscosity of from about 0.1 to about 0.8 are particularly preferred.

From the standpoint of utility, as well as for commercial and economical reasons, mixed esters in which the high molecular weight ester group has from 8 to 24 aliphatic carbon atoms, the low molecular weight ester group has from 3 to 5 carbon atoms, and the carbonyl polyamino group where required or optional is derived from a primary-aminoalkyl-substituted tertiary amine, or heterocyclic amine. Specific examples of the high molecular weight alkyl in the carboxylic ester include heptyl, isooctyl, decyl, dodecyl, tridecyl, tetradecyl, pentadecyl, hexadecyl, octadecyl, eicosyl, tricosyl, tetracosyl, etc. Specific examples of the low molecular weight alkyl in the carboxylic ester include methyl, ethyl, n-propyl, isopropyl, n-butyl, sec-butyl, iso-butyl, n-pentyl, neo-pentyl, n-hexyl, cyclohexyl, cyclopentyl, 2-methyl-butyl, 2,3-dimethyl-butyl, etc. In most instances, alkyl groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one tertiary amine or nitrogen heterocyclic moiety such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiazines, amidines, etc. Examples of such polyamino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridyl-ethylamine, bis-(dimethylaminopropyl)amine, bis-(diethylaminoethyl)amine, N,N-dimethyl-p-phenylene diamine, piperidyl-ethylamine, 1-aminoethyl pyrazole, 1-(methylamino)pyrazoline, 1-methyl-4-amino-octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1-aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzo-pyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, styrene, or isobutene. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, as in (B)(2), it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include acrylic acid and methacrylic acid, their alkyl esters, acrylamide and methacrylamide and their N-substituted derivatives, itaconic acid and anhydride, citraconic acid and anhydride, isobutylene, diisobutylene and higher oligomers, t-butylstyrene and methylstyrene isomers. Alpha-methylstyrene, acrylic and methacrylic esters are preferred; esters of methacrylic acid are most preferred. Terpolymers of styrene, maleic anhydride and esters of methacrylic acid are preferred.

The carboxy-containing interpolymers are obtained by polymerization of alpha, beta-unsaturated acids, anhydrides or esters thereof, with a low molecular weight aliphatic olefin or styrene in a suitable solvent. The temperature range for the reaction is from the melting point of the reactants to the decomposition temperature of the components, preferably from about 40° C. to about 150° C. The alpha, beta unsaturated acid or anhydride, usually as a solution in aromatic solvent, is heated from ambient temperature to the reaction temperature. A portion of a free radical initiator is added at the reaction temperature. The remainder of the free radical initiator and the low molecular weight aliphatic olefin are added dropwise over about 20 to about 180 minutes. A vacuum, about 30 to about 760 torr, may be used to control the reaction temperature by effecting reflux. The total time of polymerization is usually from about 1 to about 8 hours. The solvents employed provide a medium for polymerization as well as contribute to the control of molecular weight of the interpolymer by acting as a chain transfer agent, (e.g., act to terminate the propagating free radical). Examples of solvents suitable for the reaction are toluene, xylene, benzene and cumene. The preferred solvents are xylene and toluene; most preferred is toluene.

The free radical initiator should decompose to provide enough free radicals to form the interpolymers. Polymerization conditions are chosen such that the half life of a free radical initiator is from about 0.3 about 2 hours, with 0.5 to 1 hour preferred. An example of a suitable initiator is benzoyl peroxide, although other peroxides, peresters and azo initiators may be employed.

The addition time of the low molecular weight aliphatic olefin or styrene monomer controls the molecular weight. For faster addition of this monomer, the molecular weight is higher. Therefore, it is preferred that this monomer is added over about 30 to about 120 minutes, and most preferred over 45–100 minutes. A portion of the free radical initiator is added at reaction temperature immediately before addition of the low molecular weight aliphatic olefin or styrene monomer. This initial portion is from one-fourth to three-fourths of the total amount of the initiator. Preferably, one-half of the initiator is added before the low molecular weight aliphatic olefin or styrene monomer addition is begun. The addition time for the remainder of the free radical initiator is usually the same as the addition time of the low molecular weight aliphatic olefin or styrene monomer.

The process with the interpolymerizable comonomers is essentially the same as above. The interpolymerizable comonomer may be added with the alpha, beta-unsaturated carboxylic acid, anhydride or ester thereof or may be mixed with the low molecular weight aliphatic olefin or styrene monomer or with the free radical initiator. When the comonomer has little tendency to homopolymerize, it may be added with the alpha, beta-unsaturated carboxylic acid, anhydride or ester thereof as well as with the free radical initiator or low molecular weight aliphatic olefin or styrene monomer. Itaconic and citraconic acids and anhydrides are examples of comonomers of this type. Comonomers which have a tendency to homopolymerize should be added along with either the free radical initiator or the low molecular weight aliphatic olefin or styrene monomer.

The mixed esters of Component (B) are most conveniently prepared by first esterifying the carboxy-containing interpolymer with a relatively high molecular weight alcohol and a relatively low molecular weight alcohol to convert at least about 50% and no more than about 98% of the carboxy radicals of the interpolymer to ester radicals and then neutralizing the remaining carboxy radicals with a polyamino compound as in (B)(1) or optionally as in (B)(2) such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 5% to about 95%.

The esterification can be accomplished simply by heating the carboxy-containing interpolymer and the alcohol or alcohols under conditions typical for effecting esterification. Such conditions usually include, for example, a temperature of at least about 80° C., preferably from about 150° C. to about 250° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer is then treated with a polyamino compound as in (B)(1) or optionally as in (B)(2) in an amount so as to neutralize substantially all of the unesterified carboxy radicals of the interpolymer. The neutralization is preferably carried out at a temperature of at least about 80° C., often from about 120° C. to about 250° C., provided that the temperature does not exceed the decomposition point of the reaction mass. In most instances the neutralization temperature is between about 150° C. and 250° C. A slight excess of the stoichiometric amount of the polyamino compound is often desirable, so as to insure substantial completion of neutralization, i.e., no more than about 2% of the carboxy radicals initially present in the interpolymer remained unneutralized.

The following examples are illustrative of the preparation of Component (B) of the present invention. Unless otherwise indicated all parts and percentages are by weight.

EXAMPLE (B)(1)-1

A styrene-maleic anhydride copolymer is obtained by preparing a solution of styrene (16.3 parts by weight) and maleic anhydride (12.9 parts) in a benzene-toluene solution (270 parts; weight ratio of benzene:toluene being 66.5:33.5 ) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm Hg. To 209 parts of the stripped mineral oil-interpolymer slurry (the copolymer having an inherent viscosity of 0.72) there are added toluene (25.2 parts), n-butyl alcohol (4.8 parts), a commercial alcohol consisting essentially of primary alcohols having from 12 to 18 carbon atoms of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°-160° C. for 20 hours whereupon water is distilled off. An additional mount of sulfuric acid (0.18 part) together with an additional amount of n-butyl alcohol (3 parts) is added and the esterification is continued until 95% of the carboxy radicals of the polymer has been esterified. To the esterified copolymer, there is then added aminopropyl morpholine (3.71 parts; 10% in excess of the stoichiometric amount required to neutralize the remaining free carboxy radicals) and the resulting mixture is heated to 150°-160° C./10 mm. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16-0.17%.

EXAMPLE (B)(1)-2

The procedure of Example (B)(1)-1 is followed except that the esterification is carried out in two steps, the first step being the esterification of the styrene-maleic anhydride copolymer with the commercial alcohols having from 8 to 18 carbon atoms and the second step being the further esterification of the copolymer with n-butyl alcohol.

EXAMPLE (B)(1)-3

The procedure of Example (B)(1)-1 is followed except that the esterification is carried out by first esterifying the styrene-maleic anhydride copolymer with the commercial alcohol having from 8 to 18 carbon atoms until 70% of the carboxyl radicals of the copolymer have been converted to ester radicals and thereupon continuing the esterification with any yet-unreacted commercial alcohols and n-butyl alcohol until 95% of the carbonyl radicals of the interpolymer have been converted to ester radicals.

EXAMPLE (B)(1)-4

The procedure of Example (B)(1)-1 is followed except that the copolymer is prepared by polymerizing a solution consisting of styrene (416 parts), maleic anhydride (392 parts), benzene (2153 parts) and toluene (5025 parts) in the presence of benzoyl peroxide (1.2 parts) at 65°-106° C. (The resulting copolymer has an inherent viscosity of 0.42).

EXAMPLE (B)(1)-5

The procedure of Example (B)(1)-1 is followed except that the styrene-maleic anhydride copolymer is obtained by polymerizing a mixture of styrene (416 parts), maleic anhydride (392 parts), benzene (6101 parts) and toluene (2310 parts) in the presence of benzoyl peroxide (1.2 parts) at 78°-92° C. (The resulting copolymer has an inherent viscosity of 0.91).

EXAMPLE (B)(1)-6

The procedure of Example (B)(1)-1 is followed except that the styrene-maleic anhydride copolymer is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°-82° C. for about 5 hours. (The resulting copolymer has an inherent viscosity of 1.24.)

EXAMPLE (B)(1)-7

The procedure of Example (B)(1)-1 is followed except that acetone (1340 parts) is used in place of benzene as the polymerization solvent and that azobisisobutyronitrile (0.3 part) is used in place of benzoyl peroxide as a polymerization catalyst.

EXAMPLE (B)(1)-8

A copolymer (0.86 carboxyl equivalent) of styrene and maleic anhydride (prepared from an equal molar mixture of styrene and maleic anhydride and having an inherent viscosity of 0.69) is mixed with mineral oil to form a slurry, and then esterified with a commercial alcohol mixture (0.77 mole; comprising primary alcohols having from 8 to 18 carbon atoms) at 150°-160° C. in the presence of a catalytic amount of sulfuric acid until about 70% of the carboxyl radicals are converted to ester radicals. The partially esterified copolymer is then further esterified with a n-butyl alcohol (0.31 mole) until 95% of the carboxyl radicals of the copolymer are converted to the mixed ester radicals. The esterified copolymer is then treated with aminopropyl morpholine (slight excess of the stoichiometric amount to neutralize the free carboxyl radicals of the copolymer) at 150°-160° C. until the resulting product is substantially neutral (acid number of 1 to phenolphthalein indicator). The resulting product is mixed with mineral oil so as to form an oil solution containing 34% of the polymeric product.

Examples (B)(1)-1 through (B)(1)-8 are prepared using mineral oil as the diluent. All of the mineral oil or a portion thereof may be replaced with a naturally occurring triglyceride. The preferred triglyceride is rapeseed oil or the high oleic sunflower oil.

EXAMPLE (B)(1)-9

Charged to a 12 liter 4 neck flask is 3621 parts of the copolymer of Example (B)(1)-8 as a toluene slurry. The percent toluene is about 76 percent. Stirring is begun and 933 parts (4.3 equivalents) Alfol 1218 alcohol and 1370 parts xylene are added. The contents are heated and toluene is removed by distillation. Additional xylene is added in increments of 500, 500, 300 and 300 parts while continuing to remove toluene, the object being to replace the lower boiling toluene with the higher boiling xylene. The removal of solvent is stopped when the temperature of 140° C. is reached. The flask is then fitted with an addition funnel and the condenser is set to reflux. At 140° C., 23.6 parts (0.17 equivalents) methanesulfonic acid in 432 parts (3 equivalents) Alfol 810 alcohol is added in about 20 minutes. The contents are stirred overnight at reflux while collecting water in a Dean Stark trap. Then added is 185 parts (2.5 equivalents) of n-butanol containing therein 3.0 parts (0.02 equivalents) of methanesulfonic acid. This addition occurs over a 60 minute time period. The contents are maintained at reflux for 8 hours and then an additional 60 parts (0.8 equivalents) n-butanol is added and the contents are permitted to reflux overnight. At 142° C. is added 49.5 parts (0.34 equivalents) aminopropylmorpholine in 60 minutes. After a 2 hour reflux 13.6 parts (equivalents) 50% aqueous sodium hydroxide is added over 60 minutes and after an additional 60 minutes of stirring there is added 17 parts of an alkylated phenol comprising 75% 2,b-di-t-butylphenol, 15% 2,4,6-tri-t-butylphenol and 10% ortho-t-butylphenol.

To a 1 liter flask is added 495 parts of the above esterified product. The contents are heated to 140° C. and 337 parts Sunyl® 80 is added. Solvent is removed at 155° C. with nitrogen blowing at 1 cubic foot per hour. The final stripping conditions are 155° C. and 20 mm Hg. At 100° C. the contents are filtered using diatomaceous earth to give a product containing 0.3% alkylated phenol and 67% Sunyl® 80.

EXAMPLE (B)(1)-10

The procedure of Example (B)(1)-9 is followed except that RS80 is utilized instead of Sunyl 80. The RS80 content is 57% and the alkylated phenol content is 0.3%.

EXAMPLE (B)(2)-1

Mix and heat 490 parts of maleic anhydride and 6900 parts of toluene to 100° C. Prepare an initiator solution by mixing 14.3 parts of 70% benzoyl peroxide and 500 parts of toluene. Add one-half of the initiator solution to the maleic anhydride and toluene at about 100° C. Charge the remainder of the initiator solution and a mixture of 494 parts of styrene, 29.5 parts of alpha-methyl styrene and 25 parts of methyl methacrylate dropwise over 90 minutes at a constant rate. Apply a vacuum to obtain reflux at 100° C. Maintain the reaction temperature at 100° C. for 4 hours. The interpolymer obtained should have an inherent viscosity of 0.14 $dLg^{-1}$.

Charge to a suitable vessel a toluene slurry (1688 parts) having 12.32% solids and 87.68% volatiles of the interpolymer, Alfol 1218 (217 parts) and mineral oil (130 parts). Heat the mixture to 100° C. with medium agitation under nitrogen. Add sulfuric acid (4.22 parts of a 93% solution) and Alfol 810 (101 parts) to the mixture. Heat the mixture to 150° C. by removing toluene-water distillate. Add butanol (20 parts) to the mixture. Maintain the temperature of the mixture at 150° C. for 1½ hours. Add a second portion of butanol (20 parts) to the mixture. Maintain the temperature of the mixture at 150° C. until the net acid number indicates that esterification is at least 95% complete. Add 15 parts aminopropylmorpholine and di-tert-butyl phenol (1.04 parts) to the mixture. Vacuum strip the mixture at 150° C. and 100 torr. Add a second portion of di-tert-butyl phenol (1.04 parts) along with diatomaceous earth (16 parts). Cool the mixture to 100° C. and filter through a hot funnel to yield the desired product.

EXAMPLE (B)(2)-2

Utilizing the same procedure as described in Example (B)(2)-1, polymerize 490 parts of maleic anhydride with 520 parts of styrene and 25 parts of methyl methacrylate. Use 11.5 parts of benzoyl peroxide along with 7400 parts of toluene. The interpolymer obtained should have an inherent viscosity of 0.13 $dLg^{-1}$. Esterify this interpolymer utilizing the procedure described in Example (B)(2)-1. Use 257 parts of Alfol 1218, 45.2 parts of Alfol 810, 134 parts of a mineral oil, 54 parts butanol, 15 parts of aminopropylmorpholine, 2.08 parts of di-tert-butyl phenol and 16 parts of diatomaceous earth. Replace the sulfuric acid of Example (B)(2)-1 with 5.46 parts of a 70% solution of methanesulfonic acid.

EXAMPLE (B)(2)-3

Utilizing the same procedure as described in Example (B)(2)-1, polymerize 490 parts of maleic anhydride with 520 parts of styrene and 50 parts of methyl methacrylate. Use 8.5 parts of benzoyl peroxide along with 7400 parts of toluene. The interpolymer obtained should have an inherent viscosity of 0.15 $dLg^{-1}$. Esterify 212 parts of this interpolymer according to the procedure as described in Example(B)(2)-1, except use 5.46 parts of a 70% solution of methanesulfonic acid in place of sulfuric acid. Use 278 parts of Alfol 1218, 49 parts of Alfol 810, 136 parts of a mineral oil, 54 parts of butanol, 15 parts of aminopropylmorpholine, 2.08 parts of di-tert-butyl phenol; and 16 parts of diatomaceous earth.

EXAMPLE (B)(2)-4

Mix and heat 490 parts of maleic anhydride and 6900 parts of toluene to 100° C. Prepare an initiator solution by mixing 14.3 parts of 70% benzoyl peroxide and 500 parts of toluene. Add one-half of the initiator solution to the maleic anhydride and toluene at about 100° C. Charge the remainder of the initiator solution and a mixture of 494 parts of styrene, 29.5 parts of alpha-methyl styrene and 25 parts of methyl methacrylate dropwise over 90 minutes. Apply a vacuum to obtain reflux at 100° C. Maintain the reaction temperature at 100° C. for 4 hours. The interpolymer obtained should have an inherent viscosity of 0.14 $dLg^{-1}$. Charge to a suitable vessel a toluene slurry (1688 parts) having 12.32% solids and 87.68% volatiles of this interpolymer, Alfol 1218 (257 parts) and mineral oil (130 parts). Heat the mixture to 100° C. with medium agitation under nitrogen. Add sulfuric acid (4.22 parts of a 93% solution) and Alfol 810 (45 parts) to the mixture. Heat the mixture to 150° C. by removing toluene-water distillate. Add butanol (27 parts) to the mixture. Maintain the temperature of the mixture at 150° C. for 1½ hours. Add a second portion of butanol (27 parts) to the mixture. Maintain the temperature of the mixture at 150° C. until the net acid number indicates that esterification is at least 95% complete. Add sodium hydroxide (1.44 parts of a 50% aqueous solution) and Isonox 133 (1.04 parts) to the mixture. Vacuum strip the mixture at 150° C. and 100 torr. Add a second portion of Isonox 133 (1.04 parts) along with diatomaceous earth (16 parts). Cool the mixture to 100° C. and filter through a hot funnel to yield the desired product.

EXAMPLE (B)(2)-5

Mix and heat 490 parts of maleic anhydride and 6900 parts of toluene to 100° C. Prepare an initiator solution by mixing 14.3 parts of 70% benzoyl peroxide with 500 parts of toluene. Add one-half of the initiator solution to the maleic anhydride/toluene mixture. Apply a vacuum to obtain reflux at 100° C. Add the remainder of the initiator solution and a mixture of 494 parts of styrene and 59 parts of alpha-methyl styrene dropwise over 90 minutes. Maintain the reaction temperature at 100° C. for 4 hours. The interpolymer obtained should have an inherent viscosity of 0.15 $dLg^{-1}$. Esterify 208 parts of this interpolymer by the same procedure as Example (B)(2)-4. Use 257 parts of Alfol 1218, 45 parts of Alfol 810, 130 parts of mineral oil, 4.22 parts of a 93% solution of sulfuric acid, 54 parts of butanol, 1.28 parts of 50% aqueous solution of sodium hydroxide, 2 parts of Isonox 133 and 16 parts of diatomaceous earth.

EXAMPLE (B)(3)-1

Heat 490 parts of maleic anhydride and 5000 parts of toluene to 100° C. Prepare an initiator solution by mixing 2.13 parts of benzoyl peroxide and 500 parts of toluene. One-half of this solution is to be added all at once. Add 520 parts styrene and the remaining initiator solution dropwise over 40 minutes. Maintain the reaction temperature at 100° C. for 4 hours. The interpolymer obtained should have an inherent viscosity at 30° C. (1 gram/100 mls acetone) of about 0.30 $dLg^{-1}$. Charge a vessel with a toluene slurry (870 parts) having 15.5% solids and 84.5% volatiles of this interpolymer and Alfol 1218 (278 parts). Heat the mixture to 100° C. under nitrogen with medium agitation. Add sulfuric acid (3.1 parts of a 96% solution in water) and 48.7 parts of Alfol 810 to the vessel. Raise the temperature of the mixture to 145° C.–150° C. by removing toluene-water distillate. Add 301 parts of a mineral oil 150° C. Maintain the temperature of the mixture at 145° C.–150 C. until net acid number indicates that esterification is at least 75% complete. Add 26.7 parts of n-butanol dropwise over 15 minutes. Maintain the temperature of the mixture at 145° C.–150 C. for 3 hours. Add solution of sulfuric acid (0.52 parts of a 96% solution) and 26.7 parts of butanol dropwise over 10 minutes. Maintain the temperature of the mixture at 145° C.–150° C. until the net acid number indicates that the esterification is at least 95% complete. Add sodium hydroxide (0.96 parts of a 50% aqueous solution) to the mixture, and add Ethyl Antioxidant 733 (1.36 parts) to the mixture. Vacuum strip the mixture at 155° C. and 5 torr. Add diatomaceous earth (10 parts) to the mixture along with Ethyl Antioxidant 733 (1.36 parts). Cool the mixture to 100° C. and filter through a heated funnel to yield the desired product.

EXAMPLE (B)(3)-2

Esterify a toluene slurry (928 parts) having 15.5% solids and 84.5% volatiles of the interpolymer of Example (B)(3)-1 utilizing the same procedure as Example (B)(3)-1. Use 348 parts Alfol 1218, 61 parts Alfol 810, 4.53 parts of a 96% sulfuric acid solution, 293 parts of a mineral oil, 66.6 parts of butanol, 1.46 parts of Ethyl Antioxidant 733 and 109 parts of diatomaceous earth.

EXAMPLE (B)(3)-3

Mix and heat 490 parts of maleic anhydride and 5000 parts of xylene to 100° C. Prepare an initiator solution by mixing 17 parts of 70% benzoyl peroxide with 500 parts of xylene. Add the initiator solution in one portion at 100° C. Apply a vacuum to affect reflux. At 100° C. add 520 parts of styrene over 20 minutes. The reaction is very exothermic. Maintain the reaction temperature at 100° C. for 4 hours after the addition is completed. The interpolymer obtained should have an inherent viscosity of 0.15 $dLg^{-1}$. Charge to a suitable vessel this interpolymer (404 parts) and Alfol 1218 (555 parts). Heat the mixture to 100° C. with agitation under nitrogen. Add Alfol 810 (98 parts) and 70% methanesulfonic acid (6.4 parts) to the mixture. Raise the temperature to 150° C. by removal of water-xylene distillate. Maintain the temperature of the mixture at 150° C. until net acid number indicates that esterification is at least 75% complete. Add butanol (104 parts) dropwise to the mixture. Maintain the temperature of the mixture at 150° C. until the net acid number indicates that esterification is at least 95% complete. Add Ethyl Antioxidant 733 (4.6 parts) and sodium hydroxide (2 parts of a 50% aqueous solution) to the mixture. Vacuum strip the mixture at 150° C. and 20 torr. Cool the mixture to 100° C. and add Ethyl Antioxidant 733 (4.6 parts) and diatomaceous earth (36 parts) to the mixture. Filter the mixture through a heated funnel to yield the desired product.

EXAMPLE (B)(3)-4

Heat 490 parts of maleic anhydride and 5000 parts of toluene to 60° C. Prepare an initiator solution by mixing 0.5 parts of Percadox 16 (4-t-butylcyclohexyl peroxy dicarbonate from Noury Chemical Company) and 500 parts of toluene. One-half of this solution is to be added all at once. Add the styrene and the remaining initiator solution dropwise over 40 minutes. Maintain the reaction temperature at 60° C. for 4 hours. The interpolymer obtained should have an inherent viscosity at 30° C. (1 gram/100 mls acetone) of about 1.5 $dLg^{-1}$. Esterify this interpolymer by the same procedure as (B)(3)-3. Use 257 parts of Alfol 1218, 45 parts of Alfol 810, 130 parts of a mineral oil, 4.2 parts of a 93% sulfuric acid solution, 54 parts butanol, 1.21 parts of a 50% aqueous sodium hydroxide solution, 2 parts of Isonox 133 and 16 parts of diatomaceous earth.

EXAMPLE (B)(3)-5

Heat 490 parts of maleic anhydride and 5000 parts of toluene to 60° C. Prepare an initiator solution by mixing 1.0 parts of Percadox 16 with 500 parts of toluene. One-half of the initiator solution is to be added to the maleic anhydride and toluene solution at 60° C. Add 520 parts of styrene and the remainder of the initiator solution dropwise over 60 minutes. Maintain temperature at about 60° C. for 4 hours by applying a vacuum to affect reflux. The interpolymer obtained should have an inherent viscosity of 0.8 $dLg^{-1}$. Esterify this interpolymer by the procedure utilized in Example (B)(3)-3. Use 278 parts of Alfol 1218, 49 parts of Alfol 810, 362 parts of a mineral oil, 4.21 parts of a 93% sulfuric acid solution, 54 parts butanol, 1.28 parts of a 50% aqueous sodium hydroxide solution, 1.72 parts of Isonox 133 and 20 parts of diatomaceous earth.

In addition to components (A) and (B) the compositions of this invention may also include (C) a synthetic ester base oil.

(C) The Synthetic Ester Base Oil

The synthetic ester base oil comprises the reaction of a monocarboxylic acid of the formula $$R^4COOH,$$

a dicarboxylic acid of the formula $$\begin{array}{l} R_5-CHCOOH\ , \\ \quad\ \ |\ \ \ \ integer of from 0 to about 6, and p is an integer of from 1 to 4; with an alcohol of the formula $$R^7[O(CH_2\overset{R^{14}}{\overset{|}{C}}HO)_tH]_n$$

wherein $R^7$ is an aliphatic group containing from 1 to about 24 carbon atoms or an aromatic group containing from 6 to about 18 carbon atoms, $R^{14}$ is hydrogen or an alkyl group containing 1 or 2 carbon atoms, t is from 0 to about 40 and n is from 1 to about 6.

Within the monocarboxylic acid, $R^4$ preferably contains from about 6 to about 18 carbon atoms. An illustrative but non-exhaustive list of monocarboxylic acids are the isomeric carboxylic acids of butanoic, hexanoic, octanoic, nonanoic, decanoic, undecanoic, dodecanoic, palmitic, and stearic acids.

Within the dicarboxylic acid, $R^5$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^6$ preferably contains from about 6 to about 18 carbon atoms and p is 2. Aryl carboxylic acids having utility are benzoic, toluic, ethylbenzoic, phthalic, isophthalic, terephthalic, hemimellitic, trimellitic, trimeric, and pyromellitic acids.

Within the alcohols, $R^7$ preferably contains from about 3 to about 18 carbon atoms and t is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^7$ is derived include 1-octanol, 1-decanol, 1-dodecanol, 1-tetradeconal, 1-hexadecanol, 1-octadecanol, oleyl alcohol, linoleyl alcohol, linolenyl alcohol, phytol, myricyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1-10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3,propanediol (trimethylolpropane), bis-trimethylolpropane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $$CH_3(CH_2)_xCH_2(OCH_2CH_2)_nOH$$

wherein x varies between 4 and 16 and n is a number between about 3 and 11. Specific examples of ALFONIC® ethoxylates characterized by the above formula include ALFONIC® 1012-60 wherein x is about 8 to 10 and n is an average of about 5.7; ALFONIC® 1214–70 wherein x is about 10–12 and n is an average of about 10.6; ALFONIC® 1412-60 wherein x is from 10–12 and n is an average of about 7; and ALFONIC® 1218-70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23-6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of 1 COOH per 1 OH group using esterification procedures, conditions and catalysts known in the art.

A non-exhaustive list of companies that produce synthetic esters and their trade names are BASF as Glissofluid, Ciba-Geigy as Reolube, JCI as Emkarote, Oleofina as Radialube and the Emery Group of Henkel Corporation as Emery.

The compositions of this invention, components (A) and (B) or components. (A), (B) and (C) may further contain (D) an antioxidant selected from the group consisting of (1) a phenol of Formula I

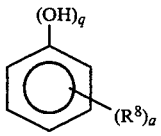

(I)

wherein $R^8$ is hydrogen or a hydrocarbyl group containing from 1 up to about 24 carbon atoms and a is an integer of from 1 up to 5, q is an integer of from 1 up to 3 with the proviso that the sum of a and q does not exceed 6, or an alkyl phenol of Formula II

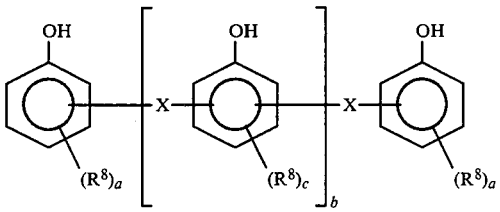

II wherein $R^8$ is an alkyl group containing from 1 up to about 24 carbon atoms, X is a sulfur or methylene, a is an integer of from 1 up to 4, b is an integer of from 0 up to about 10 and c is an integer of from 1 up to 3;

(2) an aromatic amine of the formula

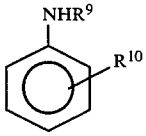

wherein $R^9$ is

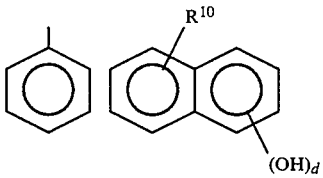

or

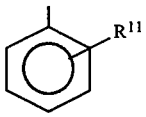

and $R^{10}$ and $R^{11}$ are independently a hydrogen or an alkyl group containing from 1 up to about 24 carbon atoms and d is 0 or 1; and (3) a phosphite ester of the formula

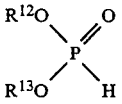

wherein each of $R^{12}$ and $R^{13}$ is an alkyl group containing from 1 up to about 24 carbon atoms.

(D)(1) The Phenols of Formula I and Formula II

Within this formula, $R^8$ preferably contains from 1 up to about 8 carbon atoms, q is 1, and a is from 1 up to about 3.

Within this formula, $R^8$ preferably contains from 1 up to about 8 carbon atoms, a is from 1 up to about 3, b is from 1 up to about 4 and C is 1 or 2. When x is sulfur, the phenol of Formula II is made by sulfurizing a phenol with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

When x is methylene, the phenol of Formula II is made by reacting a phenol with formaldehyde in the presence of an acid or basic catalyst. Such linked phenates as well as sulfurized phenates are described in detail in U.S. Pat. No. 3,350,038; particularly columns 6–8 thereof, which is hereby incorporated by reference for its disclosure in this regard.

(D)(2) The Aromatic Amine

Within the aromatic amine, preferably $R^9$ is,

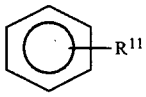

and $R^{10}$ and $R^{11}$ are alkyl groups. In a particularly advantageous embodiment, the aromatic amine is a nonylateddiphenylamine of the formula

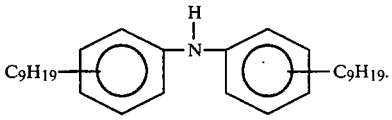

(D)(3) The Phosphite Ester

Within the phosphite ester, $R^{12}$ and $R^{13}$ are preferably from 4 to 12 carbon atoms and most preferably from 8 to 10 carbon atoms.

The $R^{12}$ and $R^{13}$ groups may comprise a mixture of alkyl groups derived from commercial alcohols. Examples of some preferred monohydric alcohols and alcohol mixtures include the commercially available "Alfol" alcohols marketed by Vista Chemical. Alfol 810 is a mixture containing alcohols consisting essentially of straight-chain, primary alcohols having 8 and 10 carbon atoms. Alfol 12 is a mixture comprising mostly $C_{12}$ fatty alcohols. Alfol 1218 is a mixture of synthetic, primary, straight-chain alcohols having 12 to 18 carbon atoms. The Alfol20+ alcohols are mostly, on an alcohol basis, $C_{20}$ alcohols as determined by GLC (gas-liquid-chromatography). The Alfol 22+ alcohols are $C_{18-28}$ primary alcohols having mostly, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight-chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Sherex Corporation.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5 of $C_{10}$ alcohol, 66.0% of $C_{12}$ alcohols, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols, Neodol 45 is a mixture of $C_{14}$ and $C_{15}$ alcohols. Neodol 91 is a mixture of $C_9$, $C_{10}$ and $C_{11}$ alcohols.

The dihydrocarbyl phosphites (D)(3) useful in the present invention may be prepared by techniques well known in the art, and many dihydrocarbyl phosphites are available commercially. In one method of preparation, a lower molecular weight dialkylphosphite (e.g., dimethyl) is reacted with alcohols comprising a straight-chain alcohol, a branched-chain alcohol or mixtures thereof. As noted above, each of the two types of alcohols may themselves comprise mixtures. Thus, the straight-chain alcohol may comprise a mixture of straight-chain alcohols and the branched-chain alcohols may comprise a mixture of branched-chain alcohols. The higher molecular weight alcohols replace the methyl groups (analogous to classic transesterification) with the formation of methanol which is stripped from the reaction mixture.

In another embodiment, the branched chain hydrocarbyl group can be introduced into a dialkylphosphite by reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group, and, apparently because of the size of the neopentyl group, the second methyl group is not displaced by the neopentyl alcohol. Another neo alcohol having utility in this invention is 2,2,4-trimethyl-1-pentanol.

The following examples illustrate the preparation of the phosphite esters (B) which are useful in the compositions of the present invention. Unless otherwise indicated in the following examples and elsewhere in the specification and claims, all parts and percentages are by weight, and all temperatures are in degrees centigrade.

EXAMPLE (D)(3)-1

A mixture of 911.4 parts (7 moles) of 2-ethylhexanol, 1022 parts (7 moles) of Alfol 8-10, and 777.7 parts (7 moles) of dimethylphosphite is prepared and heated to 125° C. while sparging with nitrogen and removing methanol as a distillate. After about 6 hours, the mixture was heated to 145° C. and maintained at this temperature for an additional 6 hours whereupon about 406 parts of distillate are recovered. The reaction mixture is stripped to 150° C. at 50 mm. Hg., and an additional 40 parts of distillate are recovered. The residue is filtered through a filter aid and the filtrate is the desired mixed dialkyl hydrogen phosphite containing 9.6% phosphorus (theory, 9.7%).

EXAMPLE (D)(3)-2

A mixture of 468.7 parts (3.6 moles) of 2-ethylhexanol, 1050.8 parts (7.20 moles) of Alfol 8-10, and 600 parts (5.4 moles) of dimethylphosphite is prepared and heated to 135° C. while purging with nitrogen. The mixture is heated slowly to 145° C. and maintained at this temperature for about 6 hours whereupon a total of 183.4 parts of distillate are recovered. The residue is vacuum stripped to 145° C. (10 mm. Hg.) and 146.3 parts of additional distillate are recovered. The residue is filtered through a filter aid, and the filtrate is the desired product containing 9.3% phosphorus (theory, 9.45%).

EXAMPLE (D)(3)-3

A mixture of 518 parts (7 moles) of n-butanol, 911.4 parts (7 moles) of 2-ethylhexanol, and 777.7 parts (7 moles) of dimethylphosphite is prepared and heated to 120° C. while blowing with nitrogen. After about 7 hours, 322.4 parts of distillate are collected, and the material then is vacuum stripped (50 mm. Hg. at 140° C.) whereupon an additional 198.1 parts of distillate are recovered. The residue is filtered through a filter aid, and the filtrate is the desired product containing 12.9% phosphorus (theory, 12.3%).

EXAMPLE (D)(3)-4

A mixture of 193 parts (2.2 moles) of 2,2-dimethyl-1-propanol and 242 parts (2.2 moles) of dimethylphosphite is prepared and heated to about 120° C. while blowing with nitrogen. A distillate is removed and collected, and the residue is vacuum stripped. The residue is filtered nd the filtrate is the desired product containing 14.2% phosphorus.

The compositions of the present invention comprising components (A) and (B) or (A), (B) and (C) or (A), (B) and (D) or (A), (B), (C) and (D) are useful in passenger car motor oils (PCMO), gear oils, automatic transmission fluids (ATF), hydraulic fluids, chain bar lubricants, way lubricants for machinery operations, diesel lubricants and tractor fluids.

When the composition comprises components (A) and (B), the (A):(B) weight ratio is generally from 75:25 to 99.9:0.1, preferably from 80:20 to 99.5:0.5 and most preferably from 85:15 to 99:1.

When the composition comprises components (A), (B) and (C) or (D), the following states the ranges of these components in parts by weight

| Component | Generally | Preferred | Most Preferred |
|---|---|---|---|
| (A) | 50–99 | 60–90 | 70–85 |
| (B) | 0.1–30 | 1–20 | 5–20 |
| (C) or (D) | 0.01–60 | 1–40 | 1–20 |

When the composition comprises components (A), (B), (C) and (D), the following states the ranges of these components in parts by weight

| Component | Generally | Preferred | Most Preferred |
|---|---|---|---|
| (A) | 40–99 | 60–90 | 70–85 |
| (B) | 0.1–30 | 1–20 | 5–20 |
| (C) | 1–60 | 5–50 | 10–40 |
| (D) | 0.01–25 | 0.1–20 | 0.5–15 |

It is understood that other components besides (A), (B), (C) and (D) may be present within the composition of this invention.

The components of this invention are blended together according to the above ranges to effect solution. The following Table I outlines examples so as to provide those of ordinary skill in the art with a complete disclosure and description on how to make the composition of this invention and is not intended to limit the scope of what the inventors regard as their invention. All parts are by weight. The parts of component (B) are adjusted to reflect an oil free product; i.e., the RS80 content of Example (B)(1)-10 is 57%. The 2.135 parts utilized in Example 6 is oil free and component (A) reflects that 57% RS80 content. Additional RS80 is utilized to give 97.85 parts RS80.

TABLE I

| EXAMPLE | (A) | (B) | (C) | (D) | 100° C. VIS (cST) | % INCREASE IN VIS |
|---|---|---|---|---|---|---|
| 1 | 100 PARTS SUNYL 80 (BASELINE) | | | | 8.59 | — |
| 2 | 98.68 PARTS SUNYL 80 | 1.308 PARTS EXAMPLE (B)(1)-9 | | 0.012 PARTS ALKYLATED PHENOL WITHIN (B)(1)-9 | 14.46 | 68.3 |
| 3 | 90 PARTS SUNYL 80 | 1 PART EXAMPLE (B)(1)-4 (Note) | 10 PARTS GLISSOFLUID A-9 | | 9.51 | 10.7 |
| 4 | 90 PARTS SUNYL 80 | 1 PART EXAMPLE (B)(1)-8 (Note) | 10 PARTS GLISSOFLUID A-9 | | 10.45 | 29.3 |
| 5 | 100 PARTS RS80 (BASELINE) | | | | 8.31 | — |
| 6 | 97.85 PARTS RS80 | 2.135 PARTS EXAMPLE (B)(1)-10 | | 0.015 PARTS ALKYLATED PHENOL WITHIN (B)(1)-10 | 15.71 | 89.0 |
| 7 | 90 PARTS RS80 | 1 PART EXAMPLE (B)(1)-4 | 10 PARTS GLISSOFLUID A-9 | | 9.33 | 12.3 |
| 8 | 90 PARTS RS80 | 1 PART EXAMPLE (B)(1)-8 | 10 PARTS GLISSOFLUID A-9 | | 10.24 | 23.2 |

Note:
(B)(1)-4 and (B)(1)-8 were repeated using Sunyl 80 at an equal replacement level.

What is claimed is:

1. An environmentally friendly viscosity index improving composition comprising:

(A) at least one vegetable or synthetic triglyceride oil of the formula

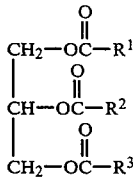

wherein $R^1$, $R^2$ and $R^3$ are aliphatic hydrocarbyl groups having at least 60 percent monounsaturated character and containing from about 6 to about 24 carbon atoms and further wherein an oleic acid moiety:linoleic acid moiety is from about 2 up to about 90, and (B) at least one mixed ester of a carboxy-containing interpolymer.

2. The composition of claim 1 wherein the triglyceride is a vegetable oil triglyceride comprising high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein.

3. The composition of claim 2 wherein the vegetable oil triglyceride is an ester of at least one straight chain fatty acid and glycerol wherein the fatty acid contains from about 8 to about 22 carbon atoms.

4. The composition of claim 3 wherein the triglyceride is at least 70 percent monounsaturated.

5. The composition of claim 4 wherein the triglyceride is at least 80 percent monounsaturated.

6. The composition of claim 5 wherein the monounsaturated fatty acid is oleic acid.

7. The composition of claim 1 wherein the carboxy-containing interpolymer (B) comprises (1) a nitrogen-containing mixed ester having an inherent viscosity of from about 0.05 to about 2 and being derived from at least two monomers, one of said monomers being a low molecular weight aliphatic olefin or styrene and the other of said monomers being an alpha, beta-unsaturated aliphatic acid, dicarboxylic acid, anhydride or ester thereof, wherein the carboxylic acid, dicarboxylic acid, anhydride or ester is at least 80 percent esterified after polymerization and being characterized by the presence within its polymeric structure of at least one of each of three pendant polar groups which are derived from the carboxy groups of said nitrogen-containing ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, (C) a carbonyl-polyamino group derived from a polyamino compound having one primary or secondary amino group, wherein the molar ratio of (A):(B):(C) is (50–95):(5–50):(0.1–15);

(2) a mixed ester of a terpolymer having an inherent viscosity of from about 0.05 to about 2, of a low molecular weight aliphatic olefin or styrene, an alpha, beta-unsaturated carboxylic acid, dicarboxylic acid, anhydride or ester thereof, and an interpolymerizable comonomer wherein the carboxylic acid, dicarboxylic acid, dicarboxylic acid, anhydride or ester is at least 80 percent esterified and wherein the ester contains pendant polar groups (A) and (B) wherein:

(A) is a carboxylic ester group having at least 8 aliphatic carbon atoms in an alkyl portion of the ester radical, (B) is a relatively low molecular weight carboxylic ester group having no more than 7 aliphatic carbon atoms in the ester radical, wherein the molar ratio of (A):(B) is (1–20):(1), and optionally (C) a carbonyl-polyamino group derived from a polyamino compound having one primary or secondary amino group, wherein the molar ratio of (A):(B):(C) is (50–95):(5–50):(0.1–15); and (3) a nitrogen-free mixed ester of a carboxy-containing interpolymer having an inherent viscosity of from about 0.05 to about 2.0 and being derived from at least two monomers, one of said monomers being a low molecular weight aliphatic olefin or styrene and the other of said monomers being an alpha, beta-unsaturated aliphatic acid, dicarboxylic acid, anhydride or ester thereof, wherein the carboxylic acid, dicarboxylic acid, anhydride or ester is at least 80 percent esterified and wherein the ester contains pendant polar groups (A) and (B) comprising:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, wherein the molar ratio of (A):(B) is (1–20):(1).

8. The composition of claim 7 wherein the alpha, beta-unsaturated aliphatic acid comprises maleic acid, iraconic acid, acrylic acid or methacrylic acid.

9. The composition of claim 7 wherein the alpha, beta-unsaturated aliphatic anhydride comprises maleic anhydride or itaconic anhydride.

10. The composition of claim 7 wherein the alpha, beta-unsaturated ester is an acrylic acid ester or methacrylic acid ester.

11. The composition of claim 7 wherein the molar ratio of (A):(B) is (1–20):(1).

12. The composition of claim 7 wherein the molar ratio of (A):(B):(C) is (60–80):(15–25):(0.1–10).

13. The composition of claim 7 wherein the ester is at least 90 percent esterified.

14. The composition of claim 7 wherein the interpolymerizable comonomer comprises acrylic acid, esters of acrylic acid, methacrylic acid, esters of methacrylic acid, methacrylamide, and N-substituted methacrylamides, itaconic acid and anhydride, citraconic acid and anhydride, isobutylene, diisobutylene and higher oligomers and methylstyrene monomers.

15. The composition of claim 7 wherein the interpolymer is a styrene-maleic anhydride interpolymer having an inherent viscosity of from about 0.1 to about 0.8.

16. The composition of claim 7 wherein the relatively high molecular weight carboxylic ester group of (A) has from 8 to about 24 aliphatic carbon atoms, the relatively low molecular weight carboxylic ester group of (B) has from 3 to 5 carbon atoms and the carbonyl-polyamino group of (C) is derived from a primary-aminoalkyl-substituted tertiary amine.

17. The composition of claim 1 further comprising (C) a synthetic ester base oil comprising the reaction of a monocarboxylic acid of the formula $R^4COOH$, a dicarboxylic acid of the formula $$\begin{array}{l} R^5\text{—}CHCOOH \\ \quad\;\; | \\ \quad (CH_2)_m \\ \quad\;\; | \\ \quad CH_2COOH, \end{array}$$

or an aryl carboxylic acid of the formula $R^6\text{—}Ar(COOH)_p$ wherein $R^4$ is a hydrocarbyl group containing from about 4 to about 24 carbon atoms, $R^5$ is hydrogen or a hydrocarbyl group containing from about 4 to about 50 carbon atoms, $R^6$ is hydrogen or a hydrocarbyl group containing from 1 up to about 24 carbon atoms, m is an integer of from 0 to about 6, and p is an integer of from 1 to 4; with an alcohol of the formula $$R^7[O(CH_2\overset{\overset{R^{14}}{|}}{C}HO)_tH]_n$$

wherein $R^7$ is an aliphatic group containing from 1 to about 24 carbon atoms or an aromatic group containing from 6 to about 18 carbon atoms, $R^{14}$ is hydrogen or an alkyl group containing 1 or 2 carbon atoms, t is from 0 to about 40 and n is from 1 to about 6.

18. The composition of claim 17 wherein $R^4$ contains from about 6 to about 18 carbon atoms.

19. The composition of claim 17 wherein $R^5$ contains from about 4 to about 24 carbon atoms and m is zero.

20. The composition of claim 17 wherein $R^5$ is hydrogen and m is 4.

21. The composition of claim 17 wherein $R^6$ contains from about 6 to about 18 carbon atoms and p is 2.

22. The composition of claim 17 wherein $R^7$ contains from about 3 to about 18 carbon atoms.

23. The composition of claim 1 further comprising (D) an antioxidant selected from the group consisting of (1) a phenol of Formula I

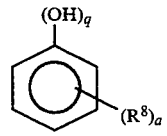

I wherein $R^8$ is hydrogen or a hydrocarbyl group containing from 1 up to about 24 carbon atoms and a is an integer of from 1 up to 5, q is an integer of from 1 up to 3 with the proviso that the sum of a and q does not exceed 6, or an alkyl phenol of Formula II

II

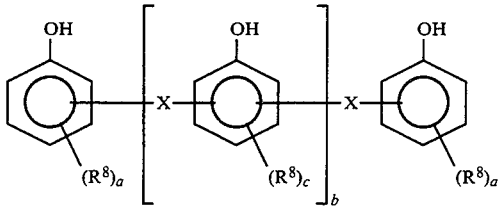

wherein $R^8$ is an alkyl group containing from 1 up to about 24 carbon atoms, X is a sulfur or methylene, a is an integer of from 1 up to 4, b is an integer of from 0 up to about 10 and c is an integer of from 1 up to 3;

(2) an aromatic amine of the formula

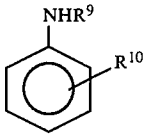

wherein $R^9$ is

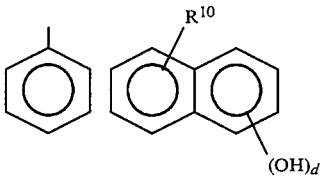

or

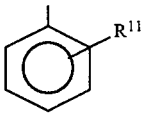

and $R^{10}$ and $R^{11}$ are independently a hydrogen or an alkyl group containing from 1 up to about 24 carbon atoms and d is 0 or 1; and (3) a phosphite ester of the formula

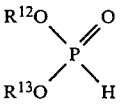

wherein each of $R^{12}$ and $R^{13}$ is an alkyl group containing from 1 up to about 24 carbon atoms.

24. The composition of claim 23 wherein within (D)(1) $R^8$ contains from 1 up to about 8 carbon atoms, q is 1, a is from 1 up to about 3, c is 1 or 2 and b is from 1 up to about 4.

25. The composition of claim 23 wherein within (D)(2) $R^9$ is

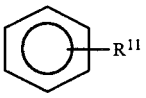

and $R^{10}$ and $R^{11}$ contain 9 carbon atoms.

26. The composition of claim 23 wherein within (D)(3) $R^{12}$ and $R^{13}$ contain from 4 to about 18 carbon atoms.

27. The composition of claim 17 wherein the alcohol is pentaerythritol, dipentaerythritol, trimethylolpropane, or bis-trimethylolpropane.

28. The composition of claim 17 further comprising (D) an antioxidant selected from the group consisting of (1) a phenol of Formula I

I

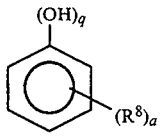

wherein $R^8$ is hydrogen or a hydrocarbyl group containing from 1 up to about 24 carbon atoms and a is an integer of from 1 up to 5, q is an integer of from 1 up to 3 with the proviso that the sum of a and q does not exceed 6, or an alkyl phenol of Formula II

II

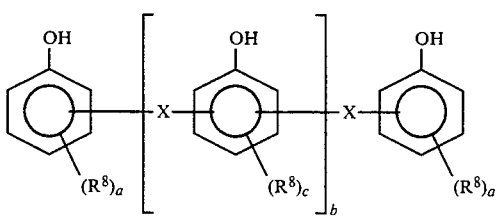

wherein $R^8$ is an alkyl group containing from 1 up to about 24 carbon atoms, X is a sulfur or methylene, a is an integer of from 1 up to 4, b is an integer of from 0 up to about 10 and c is an integer of from 1 up to 3;

(2) an aromatic amine of the formula

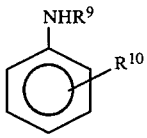

wherein $R^9$ is

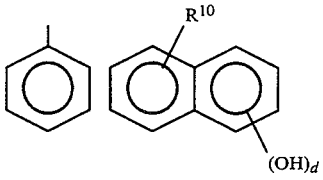

or

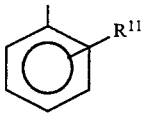

and $R^{10}$ and $R^{11}$ are independently a hydrogen or an alkyl group containing from 1 up to about 24 carbon atoms and d is 0 or 1; and (3) a phosphite ester of the formula

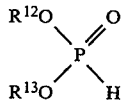
wherein each of $R^{12}$ and $R^{13}$ is a hydrocarbyl group containing from 1 up to about 24 carbon atoms.
* * * * *